US009484691B2

(12) United States Patent
Gao et al.

(10) Patent No.: US 9,484,691 B2
(45) Date of Patent: Nov. 1, 2016

(54) RJ45 SOCKET CONNECTOR HAVING A TERMINAL MODULE PRVENTING DISLODGMENT OF A TERMINAL DUE TO MISTAKEN INSERTION

(71) Applicant: FOXCONN INTERCONNECT TECHNOLOGY LIMITED, Grand Cayman (KY)

(72) Inventors: Sheng-Pin Gao, Kunshan (CN); Hai-Long Fu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/976,248

(22) Filed: Dec. 21, 2015

(65) Prior Publication Data

US 2016/0181747 A1 Jun. 23, 2016

(30) Foreign Application Priority Data

Dec. 22, 2014 (CN) ..... 2014 1 0796130

(51) Int. Cl.
*H01R 24/00* (2011.01)
*H01R 24/64* (2011.01)
*H01R 107/00* (2006.01)

(52) U.S. Cl.
CPC ..... *H01R 24/64* (2013.01); *H01R 2107/00* (2013.01)

(58) Field of Classification Search
CPC ..... H01R 13/6464; H01R 13/6466; H01R 24/62
USPC ..... 439/676
See application file for complete search history.

(56) References Cited

U.S. PATENT DOCUMENTS 5,244,412 A * 9/1993 Hatch ..... F16B 19/002 411/456
5,766,043 A * 6/1998 Talend ..... H01R 13/7197 439/607.05
5,790,660 A * 8/1998 Vlaeminck ..... H01R 24/64 379/438
6,328,595 B1 * 12/2001 Chang ..... H01R 13/6641 439/490
6,331,126 B1 * 12/2001 Wagner ..... H01R 13/6477 439/676
6,840,817 B2 1/2005 Chen
8,246,389 B2 * 8/2012 Zhang ..... H01R 13/6466 439/676
2016/0020560 A1 * 1/2016 Ju ..... H01R 24/78 439/607.05

* cited by examiner

*Primary Examiner* — Phuong Dinh
(74) *Attorney, Agent, or Firm* — Wei Te Chung; Ming Chieh Chang

(57) ABSTRACT

An RJ45 socket connector includes an insulative housing and a terminal module received in the insulative housing. The insulative housing includes a receiving space, a number of partitions, and a number of receiving passageways each formed between every two adjacent partitions. The terminal module comprises an insulative body and a row of conductive terminals insert molded in the insulative body, the conductive terminal having a fixed portion fixed in the insulative housing and an elastic contact portion extending from the fixed portion and received in a corresponding receiving passageway. The insulative body defines a trough and a number of tubers disposed in the trough, every two adjacent tubers defining a groove for accommodating a downwardly moved conductive terminal.

7 Claims, 6 Drawing Sheets

RJ45 SOCKET CONNECTOR HAVING A TERMINAL MODULE PRVENTING DISLODGMENT OF A TERMINAL DUE TO MISTAKEN INSERTION

BACKGROUND OF THE INVENTION

1. Field of the Invention

The present invention relates to an RJ45 socket connector, especially to a structure of a terminal module thereof 2. Description of Related Arts U.S. Pat. No. 6,840,817, issued on Jan. 11, 2005, discloses a stacked RJ45 socket connector. The stacking RJ45 socket connector includes an insulative housing and a plurality of terminal modules received in the insulative housing. The terminal nodule has a body and a number of conductive terminals integrated in the body. The conductive terminal has an elastic contact portion. The insulative housing has a plurality of partitions, every two adjacent partitions defining a receiving passageway, and the elastic contact portion is received in a corresponding receiving passageway. The body has a horizontal surface. The partitions extend toward the horizontal surface of the body. When an RJ11 plug is mistakenly inserted into the RJ45 socket connector, the elastic contact portion may escape the associated receiving passageway.

An improved structure of the terminal module is desired.

SUMMARY OF THE INVENTION

An object of the present invention is to provide an RJ45 socket connector including an improved structure of the terminal module.

To achieve the above-mentioned object, an RJ45 socket connector includes an insulative housing and a terminal module received in the insulative housing. The insulative housing includes a receiving space, a plurality of partitions, and a plurality of receiving passageways each formed between every two adjacent partitions. The terminal module comprising an insulative body and a row of conductive terminals insert molded in the insulative body, the conductive terminal having a fixed portion fixed in the insulative housing and an elastic contact portion extending from the fixed portion and received in a corresponding receiving passageway. The insulative body defines a trough and a plurality of tubers disposed in the trough, every two adjacent tubers defining a groove for accommodating a downwardly moved conductive terminal.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
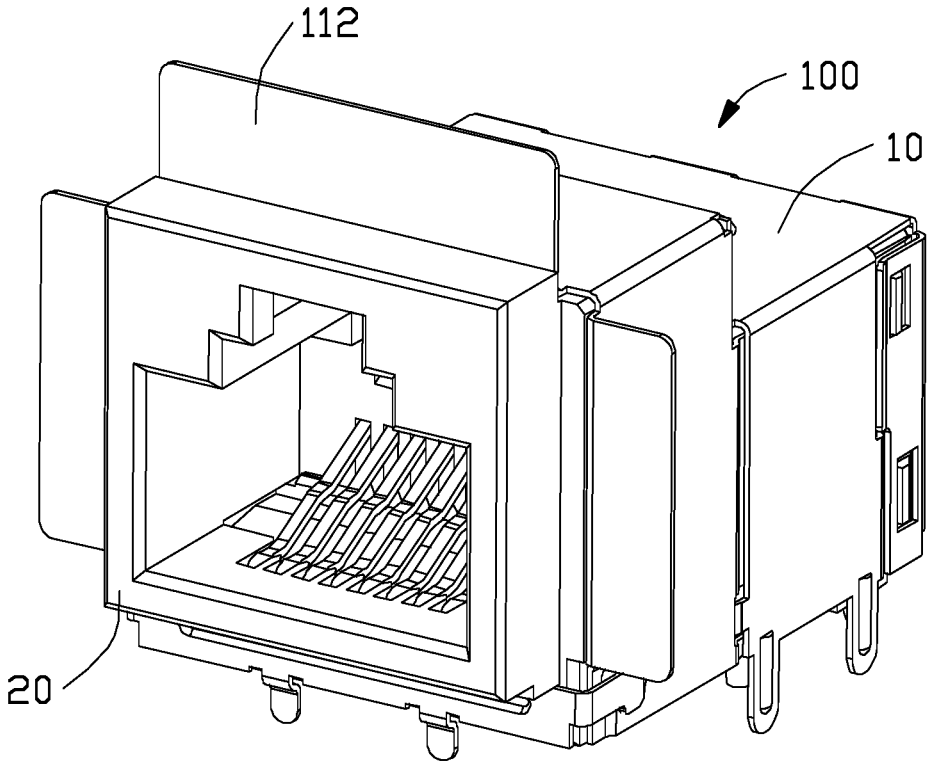
FIG. 1 is a perspective view of an RJ45 socket connector according to the present invention.
Figure 2:
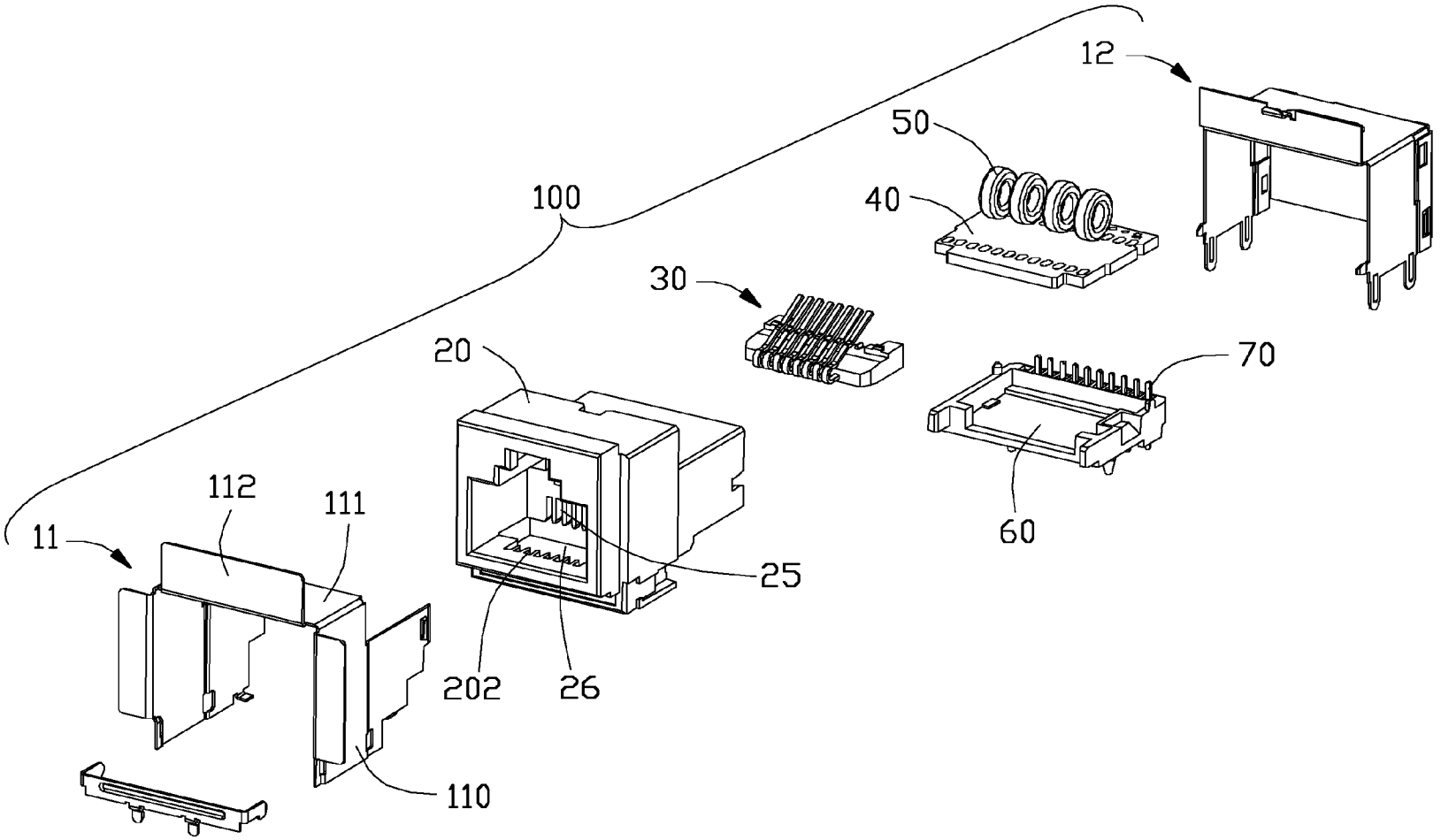
FIG. 2 is a front view of the RJ45 socket connector as shown in FIG. 1.
Figure 3:
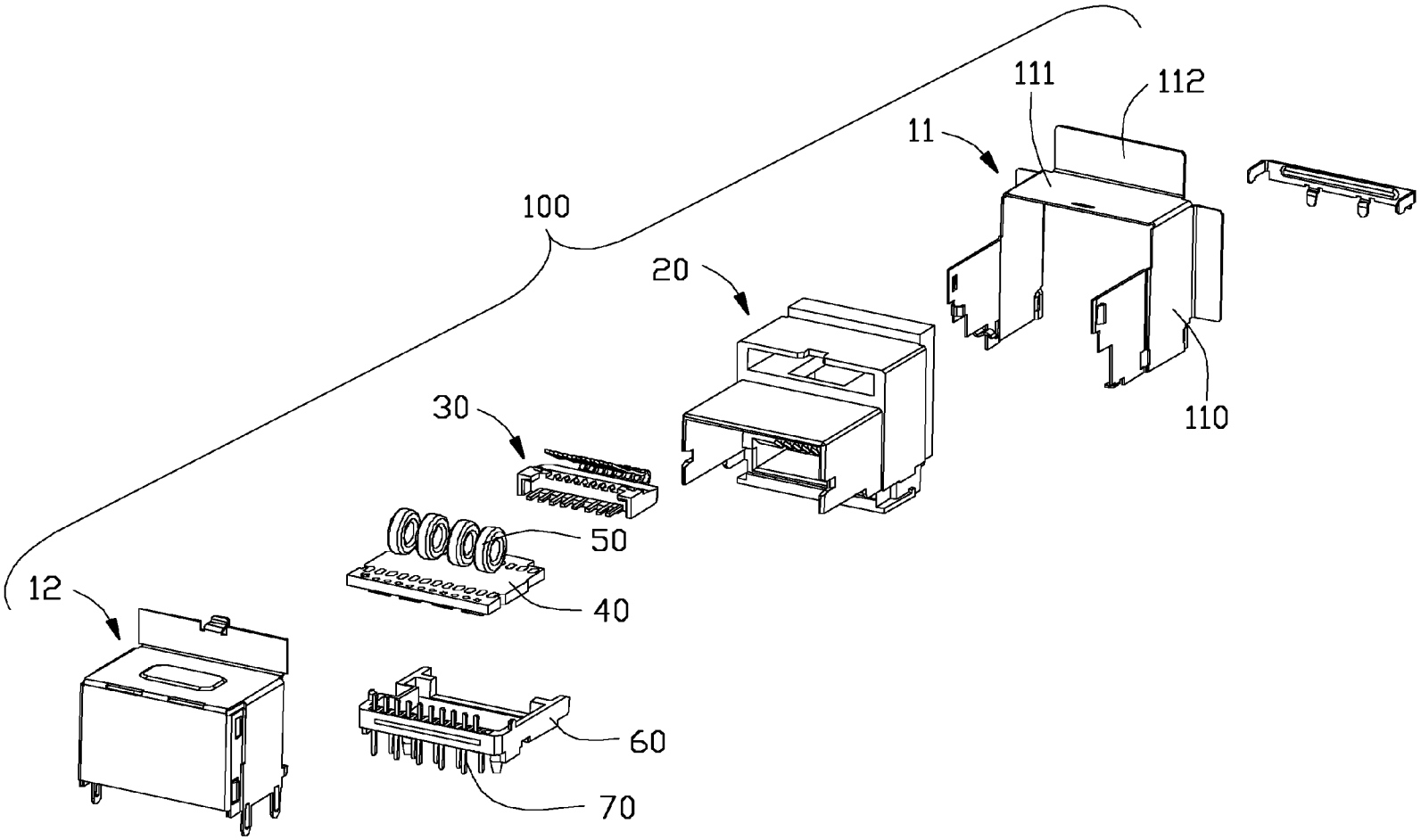
FIG. 3 is an exploded view of the RJ45 socket connector according to the present invention.
Figure 4:
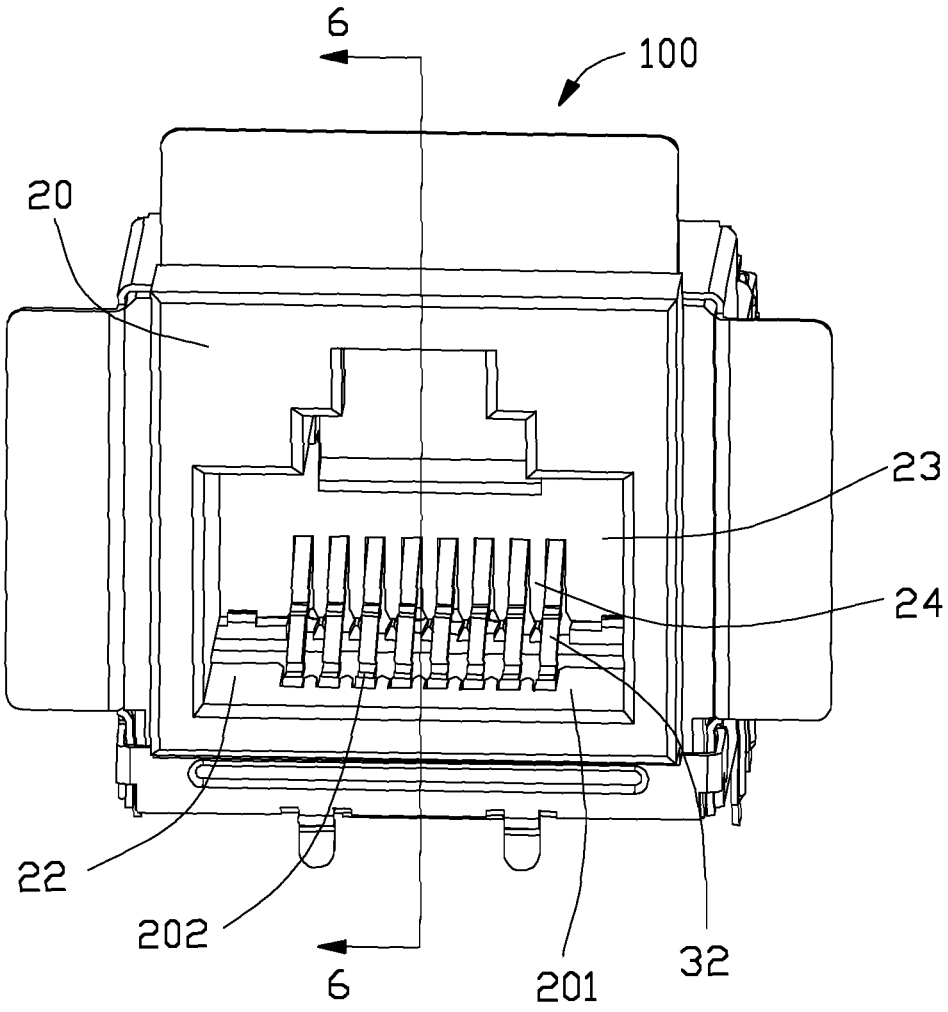
FIG. 4 is another exploded view of the RJ45 socket connector as shown in FIG. 3.
Figure 5:
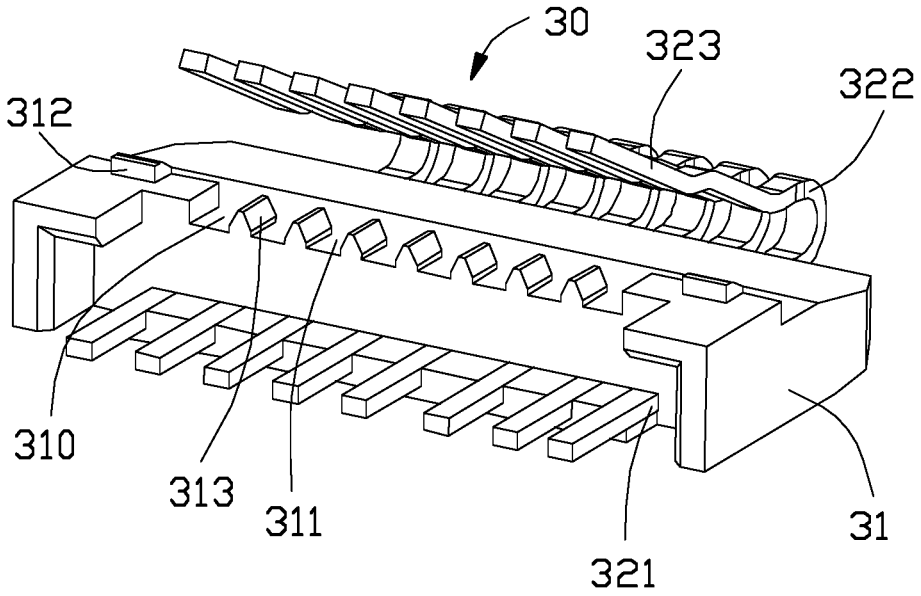
FIG. 5 is a perspective view of a terminal module of the RJ45 socket connector as shown in FIG. 1.
Figure 6:
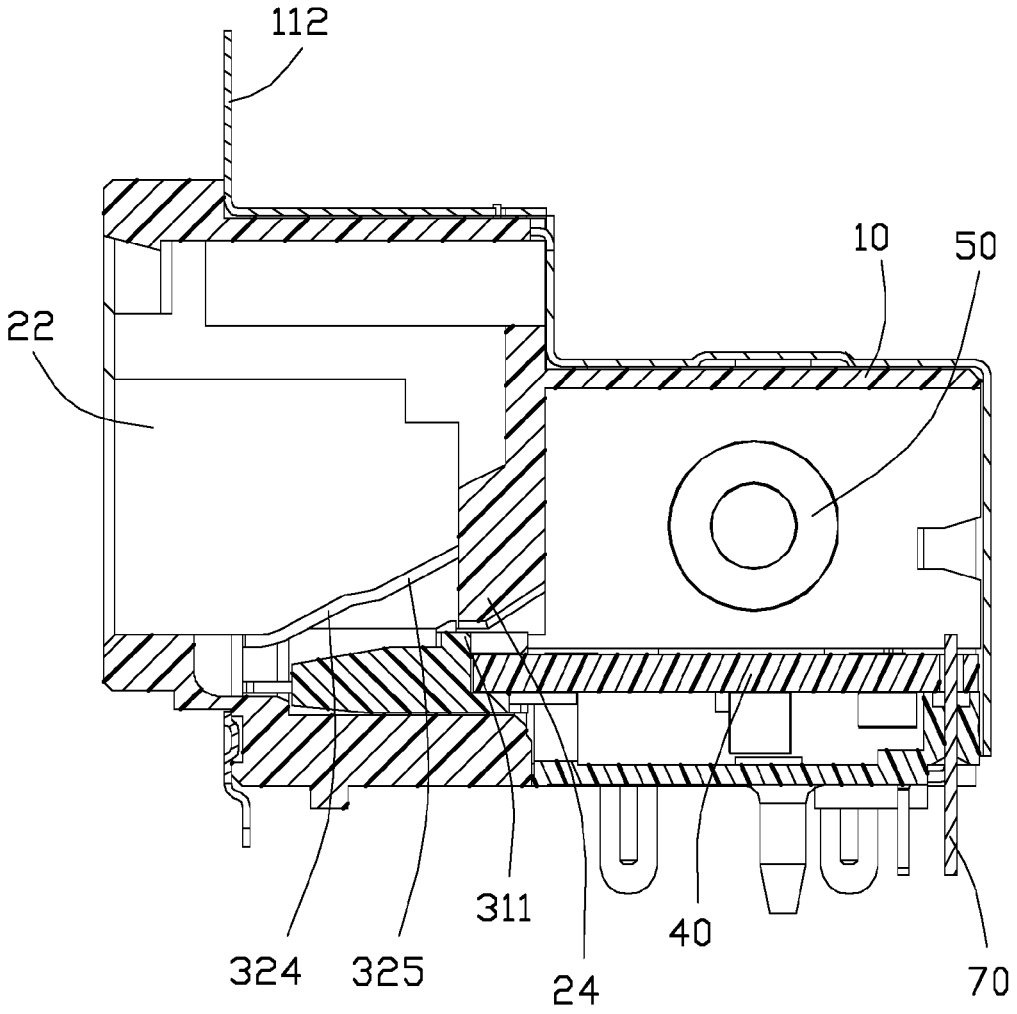
FIG. 6 is a cross-sectional view of the RJ45 socket connector taken along line 6-6 of FIG. 1

Referring to FIGS. 1-3, an RJ45 socket connector 100 can connect with a RJ45 plug. The RJ45 socket connector 100 includes a shielding shell 10, an insulative housing 20 received in the shielding shell 10, a terminal module 30 received in the insulative housing 20, an inner circuit board 40 packaged with the terminal module 30, a number of magnetic coils 50 mounted on the inner circuit board 40 and a base 60 bearing the inner circuit board 40. A number of transfer terminal 70 are mounted on the base 60 and electrically connects the RJ45 socket connector 100 to a external circuit board.

The shielding shell 10 has a front shell 11 and a rear cover 12, the front shell 11 has two side walls 110 and a top wall 111 connecting with the two side walls 110. Both of the side wall 110 and the top wall 111 define blocking plates 112 respectively perpendicular to the side wall 110 and the top wall 111. The insulative housing 20 includes a mating port 21 extending beyond the shielding shell 10. When the insulative housing 20 is mounted in the shielding shell 10, the blocking plates 112 are behind the mating port 21. Through the arrangement, the blocking plates 112 limit the position of the RJ45 socket connector 100 in a case.

Referring to FIG. 2, 4-6, in this embodiment, the insulative housing 20 further includes a receiving space 22 for receiving a mating connector, a rear wall 23, a number of partitions 24 defined in the rear wall 23 and a receiving chamber 26 by one side of the partitions 24. The partitions 24 extend along an up-to-down direction. A receiving passageway 25 is form between two adjacent partitions 24. The terminal module 30 includes an insulative body 31 and a number of conductive terminals 32 insert molding in the insulative body 31 in a row. The conductive terminal 32 includes a fixed portion 321 fixed in the insulative body 31, a bend/folded portion 322 extending from the fixed portion 321 and an elastic contact portion 323 backwardly extending from the bend portion 322. The terminal module 30 in mounted into the receiving chamber 26 from back to front, the elastic contact portion 323 is received in the receiving space 22. The elastic contact portion 323 includes a first part 324 and a second part 325 obliquely and backwardly extending from the first part 324 after the pressure. The second part 325 extends into the corresponding receiving passageway 25. The insulative housing 20 further includes a bottom wall 201 defining a number of limiting slots 202. When the terminal module 30 is mounted into insulative housing 20, the bend portion 322 of the conductive terminal 32 is received in the limiting slot 202 for determining a position of the terminal module 30. Notably, another receiving space (not labeled) is formed behind the rear wall 23 opposite to the receiving space 22 to receive the magnetic coils 50 therein.

When a RJ11 plug mistakenly inserts into the RJ45 socket connector 100, a lower surface of the RJ11 plug press the conductive terminal 32. The second part 325 is prone to plastic deformation. So in this embodiment, the insulative body 31 includes a trough 310, a number of tubers 311 set in the trough 310 and two barbs 312 in two sides of the trough 310. The barb 312 is locked in a rear wall of the insulative housing 20 when the terminal module 30 is mounted in the receiving chamber 26. Two adjacent tubers 311 form a groove 313. The second part 325 can be pressed into the corresponding groove 313 for preventing the conductive terminal 32 warped. The tuber 311 is opposite to the corresponding partition 24 and the groove 313 runs through the corresponding receiving passageway 25. Both of the tuber 311 and the corresponding partition 24 are in a same vertical direction. A distance between of the tuber 311 and the corresponding partition 24 is less than a thickness of the elastic contact portion 323. So that when the elastic contact portion 323 is pressed, the second part 325 hardly diverges from the corresponding receiving passageway 25. A width between two adjacent tubers 311 is larger than a width of the elastic contact portion 323.

The tuber 311 and the partition 24 extend to each other. In this embodiment, the tuber 311 is under the partition 24. As desired, the tuber 311 can be designed over the partition.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An RJ45 socket connector comprising:

an insulative housing comprising a receiving space, a plurality of partitions, and a plurality of receiving passageways each formed between every two adjacent partitions; and a terminal module received in the insulative housing, the terminal module comprising an insulative body and a row of conductive terminals insert molded in the insulative body, the conductive terminal having a fixed portion fixed in the insulative housing and an elastic contact portion extending from the fixed portion and received in a corresponding receiving passageway;

wherein the insulative body defines a trough and a plurality of tubers disposed in the trough, every two adjacent tubers defining a groove for accommodating a downwardly moved conductive terminal, wherein a width between two adjacent tubers is larger than a width of the elastic contact portion, and the groove runs through a corresponding receiving passageway, wherein the elastic contact portion comprises a first part and a second part backwardly extending from the first part, the second part is received in the receiving passageway, and the second part is received in a corresponding groove upon insertion of a mistakenly inserted RJ11 plug, wherein the insulative housing comprises a receiving chamber in one side of the partitions, the terminal module is mounted into the receiving chamber from a back-to-front direction, and the elastic contact portion extends into the receiving space, wherein the insulative body comprises two barbs at two sides of the groove, and the barb is locked in a rear wall of the insulative housing, wherein the insulative housing comprises a bottom wall defining a plurality of limiting slots, the conductive terminal comprises a bend portion connecting the fixed portion and the elastic contact portion, and the bend portion is received in a corresponding limiting slot.

2. The RJ45 socket connector as claimed in claim 1, wherein a distance between the tuber and the corresponding partition is less than a thickness of the elastic contact portion.

3. The RJ45 socket connector as claimed in claim 1, wherein the tuber and the partition extend toward each other.

4. The RJ45 socket connector as claimed in claim 1, further comprising a shielding shell having a front shell and a rear cover, the front shell having a vertical blocking plate, wherein the insulative housing defines a mating port extending beyond the blocking plate.

5. An electrical connector comprising:

an insulative housing including a front receiving space for receiving a mating connector and a rear receiving space divided by a rear wall in a front-to-back direction;

a plurality of partitions formed on the rear wall to form corresponding receiving passageways alternately arranged with said partitions in a transverse direction perpendicular to said front-to-back direction;

a receiving chamber located beside said partitions in a vertical direction perpendicular to both said front-to-back direction and said transverse direction;

a terminal module including a plurality of terminals insert-molded within an insulative body and commonly assembled into the receiving chamber; wherein said insulative body forms a plurality of tubers intimately aligned with the corresponding partitions in said vertical direction, respectively, and every adjacent two tubers commonly form a groove therebetween in the transverse direction; wherein deflectable contacting sections of said terminals extend into the front receiving space with distal ends being moveable in the corresponding receiving passageways confined by said partitions and the corresponding grooves confined by said tubers in the vertical direction, respectively, without risks of lateral movement, wherein said terminal module is forwardly inserted into the receiving chamber with at least one barb to rearwardly abut against the rear wall for preventing withdrawal therefrom, wherein said barb is offset from said tubers in said transverse direction, further including a printed circuit board attached to a rear region of the terminal module; wherein said printed circuit board is equipped with at least one magnetic coil received within the rear receiving space, further including a base to support said printed circuit board, wherein said tubers are formed in a trough of the insulative body, wherein said housing further includes a plurality of limiting slots aligned with and located in front of the corresponding receiving passageways, respectively, in the front-to-back direction, to receive the contacting sections of the corresponding terminals, wherein a bottom face of the groove is lower than a bottom face of the front receiving space in the vertical direction.

6. The electrical connector as claimed in claim 5, wherein a depth of said groove is large enough to receive a thickness of the corresponding terminal.

7. The electrical connector as claimed in claim 5, wherein the groove is located at a level same with an upper segment of a front folded portion of the terminal.

* * * * *